US005595518A

United States Patent [19]

Ours

[11] Patent Number: 5,595,518

[45] Date of Patent: Jan. 21, 1997

[54] FIN DEVICE, IN PARTICULAR FOR WATER SPORTS, AND METHOD OF MANUFACTURE OF SUCH A DEVICE

[76] Inventor: Roger Ours, 62, avenue Clarisse, 92420 Vaucresson, France

[21] Appl. No.: 325,255

[22] PCT Filed: Apr. 19, 1993

[86] PCT No.: PCT/FR93/00383

§ 371 Date: Oct. 24, 1994

§ 102(e) Date: Oct. 24, 1994

[87] PCT Pub. No.: WO93/22004

PCT Pub. Date: Nov. 11, 1993

[30] Foreign Application Priority Data

Apr. 23, 1992 [FR] France ..... 92 04990

[51] Int. Cl.[6] ..... A63B 31/11

[52] U.S. Cl. ..... 441/64; 264/244

[58] Field of Search ..... 411/60–64; D21/239; 425/129.1, 129.2; 264/244; 36/87, 102, 115

[56] References Cited

U.S. PATENT DOCUMENTS

| | | | |
|---|---|---|---|
| 2,865,033 | 12/1958 | Jayet | 441/64 |
| 3,239,857 | 3/1966 | Gwynne | 441/64 |
| 3,908,213 | 9/1975 | Hill | 441/64 |
| 3,922,741 | 12/1975 | Semeia | 441/64 |
| 4,120,477 | 10/1978 | Justamante | 249/109 |
| 4,954,111 | 9/1990 | Cressi | 441/64 |
| 5,266,062 | 11/1993 | Runckel | 441/64 |

FOREIGN PATENT DOCUMENTS

| | | | |
|---|---|---|---|
| 0624435 | 7/1927 | France | 441/60 |
| 2242118 | 3/1975 | France | 441/64 |
| 2543004 | 9/1984 | France . | |
| 4020235 | 1/1992 | Germany . | |

*Primary Examiner*—Edwin L. Swinehart
*Attorney, Agent, or Firm*—Young & Thompson

[57] ABSTRACT

A flipper device (1) is comprised of a fin forming front part (2) made of a relatively rigid material and device (F) for fixing the fin (2) to the foot (3) of the user. The fin (2), in its rear region (6) is fixed under the sole (4) of a foot piece (5) made of a material which is more flexible than that of the fin; at least the front part (11) of the foot piece is covered by a coating (10) of material which is more rigid than that of the foot piece (5). The coating (10) is integral with the fin (2) and is appropriate to transmit correctly an impulse from the foot (3) to the fin (2).

10 Claims, 2 Drawing Sheets

FIN DEVICE, IN PARTICULAR FOR WATER SPORTS, AND METHOD OF MANUFACTURE OF SUCH A DEVICE

This application is a 371 of PCT/FR93/00383 Apr. 19, 1993.

FIELD OF THE INVENTION

The invention relates to a fin device, of the type comprising a front part forming a blade, made of a relatively rigid material, and means of fastening the blade to the foot of the user.

The invention more particularly relates to such a fin device intended for the practice of the water sport known by the name "body-boarding", or the practice of diving, or of "aerobics" in water.

BACKGROUND OF THE INVENTION

The sport known by the name of "body-boarding" consists in trying to move on the crest or close to the crest of a wave, while remaining face-down on a board whose dimensions are generally less than those of boards used for surfing, which is performed standing on the board.

When waiting for a wave, a sportsperson who is "body-boarding" adopts a position which is favourable for him/her to be carried along by the crest of the wave. When the crest arrives, it is furthermore necessary for him/her to exert sufficient energy to gain a speed, in the same direction as the crest, which allows the phenomenon of being carried along by the wave. For this purpose, the sportsperson is generally equipped with fins which allow him/her to impart sufficient change in momentum when the crest of the wave arrives. For these operations, the fin must remain substantially at the surface of the water and furthermore contribute to steering the sportsperson and his/her board.

This explanation demonstrates why the fin must be made of a material which is sufficiently hard to allow it to strike the water efficiently and obtain the desired momentum.

It is also apparent that abrupt movements are involved and that it is important for the fin to be fastened reliably to the foot of the user.

In the case of fins intended for diving, the forces transmitted to the fin are less intense, but it is still necessary for the fin to be relatively hard in order to retain a good degree of efficiency; similarly for aerobics in water, it is necessary to exert a force which will cause energy to be expended.

When engaging in the water sports mentioned hereinabove, the sportsperson is moreover frequently called upon to walk wearing fins on his/her feet between two sporting sessions. This results in sand, or other foreign bodies, being capable of entering the fins during such a walk, which is irritating.

SUMMARY OF THE INVENTION

The object of the invention is above all to provide a fin device, of the type previously defined, which no longer, or to a lesser degree, exhibits the drawbacks mentioned hereinabove.

It is desired, in particular, for the fin device, whilst ensuring transmission, under satisfactory conditions, of momentum from the foot of the user to the blade, to exhibit a high degree of reliability as regards fastening the fin to the foot of the user, and to prevent the introduction of irritating bodies, such as grains of sand, or the like, between the fastening means and the foot of the user.

According to the invention, a fin device of the type defined previously is characterized in that the blade is fixed in its rear region under the sole of a shoe element made of a material more flexible than that of the blade and in that at least the front part of the shoe element is provided with a covering made of a material which is more rigid than that of the shoe element, this covering being solidly attached to the blade and being capable of correctly transmitting momentum from the foot to the blade.

With such a device, the efficiency of the fin is retained by virtue of good transmission of momentum from the foot to the blade, and this fin is more comfortable to use because introduction of irritating bodies, such as grains of sand, is reduced or eliminated by virtue of the shoe element which, by virtue of its flexibility, is comfortable to wear.

Preferably, the covering of the shoe element, made of a more rigid material, extends under the entire sole of this shoe element and rises, towards the rear part, to surround the heel region. The blade extends under a part of the sole, just as far as the front end of the heel, or under the entire sole. The connection between the shoe element and the blade is thus particularly resistant to tearing.

Preferably, the blade includes at least one hole in the part intended to be located under the sole, in particular for allowing injection of the covering or of an adhesive.

Advantageously, the shoe element, of the slip-on boot or bootee type, includes an upright part which surrounds the ankle of the foot of the user, this part including, towards the top, a tightening belt connected to the element by at least two loops and allowing the entire periphery of the top part of the shoe element to be tightened around the leg of the user; in the case of an ankle-length slip-on boot made of neoprene, a band of hooked fabric of the "velcro" type surrounds the foot at its instep part and passes through the sole; this fastening prevents the fin slip-on boot from being lost and gives better support to the foot. Such tightening makes it possible to prevent the introduction of foreign bodies, such as grains of sand, into the shoe, and maintains attachment of the shoe element and of the fin to the leg of the user, even in the event that the shoe element has become detached from the foot of the user.

Advantageously, the shoe element is made of neoprene or of a material having equivalent mechanical characteristics, while the covering which joins the shoe element to the blade is made of thermoplastic rubber or any thermoplastic material whose density is less than 1, for buoyancy of this fin/shoe assembly, which is made unsinkable.

The tightened belt is advantageously made of a band of fabric fitted with complementary hooks, in particular the one known by the name "velcro". The blade is advantageously equipped, on each side, with lateral ridges whose mid-plane is substantially orthogonal to the plane of the blade; the blade may include a longitudinal central rib, of lesser height than the ridges. The ridges and the rib project essentially upwards. These ridges and the rib allow the fin to have a directional action.

The hardness of the blade may vary depending on the use of the fin/shoe; the same is true for the connecting material between the shoe element and the fin.

The invention also relates to a method of manufacture of such a fin device by injection in two steps or in a single step, depending on the height of the ridges of the fins.

In the case in which the ridges are of lesser height, allowing easy demoulding, the blade and the connecting covering are made by injecting a thermoplastic in a single step into a mould containing a former on which the shoe element has been placed.

In the case in which the ridges of the fins are relatively high, the procedure is in two steps: in a first step, the blade is manufactured, by injection, from a relatively rigid material, while making at least one hole in the part of this blade intended to be located under the sole of the shoe element; in a second step, the shoe element is placed on a former arranged in mould halves, the whole being such that:

a free space is left between the internal surface of the cavity of the mould halves and the shoe element engaged on the former, in the region intended to receive the covering, and each half of the mould has an opening, under the sole of the shoe element, which is intended to be closed by a block facing a rear region of the blade, and the blade is next fitted on the block via its rear region, the block including a duct which is aligned with a hole in the blade for injecting the covering material, then, after having closed the mould, the said covering is injected and spreads into the space lying between the former, the half of the mould and a region of the blade, and establishes connection between the blade and the shoe element.

Advantageously, the covering extends under the entire sole of the shoe element and rises at the heel, this covering joining the rear part of the blade continuously.

BRIEF DESCRIPTION OF THE DRAWINGS

The invention consists, apart from the arrangements described hereinabove, of a certain number of other arrangements which will be dealt with in more detail hereinbelow with reference to one embodiment described with reference to the attached drawings, but which is no way limiting.

Finally.

DETAILED DESCRIPTION OF THE INVENTION

Figure 1:
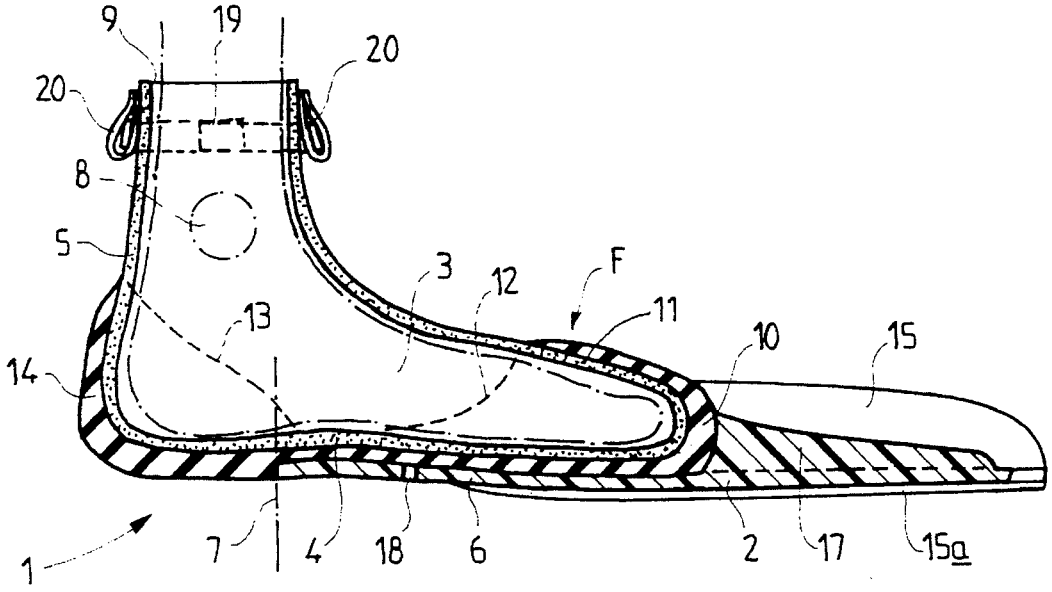
FIG. 1 of these drawings is a vertical section along the line I—I in FIG. 2 of a fin device according to the invention.
Figure 2:
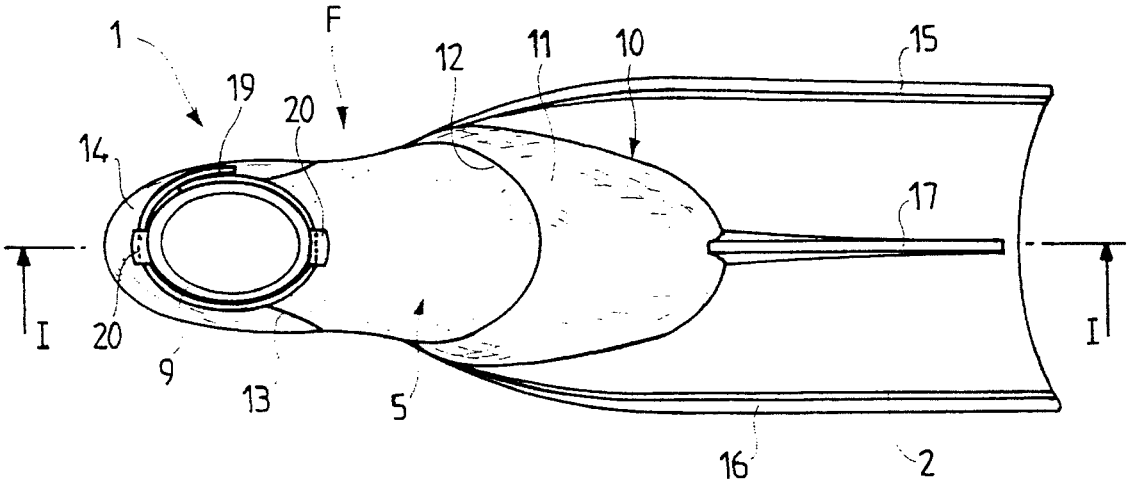
FIG. 2 is a plan view of the fin device in FIG. 1.

Referring to the drawings, in particular to FIGS. 1 and 2, a fin device i can be seen which comprises a front part 2 forming a blade, made of a relatively hard and rigid plastic, in particular thermoplastic rubber with suitable fillers for giving it the desired hardness. The hardness of the blade 2 may be of the order of 85 Shore A, and generally lies between 5 and 90 Shore A.

Fastening means F are provided for holding the blade 2 on the foot 3 of the user.

The blade 2 is fixed under the sole 4 of a shoe element 5 of the shoe or slip-on boot type, this shoe element forming part of the fastening means F. The blade 2 extends backwards, under the sole 4, by a part 6 which stops in a region 7 represented by a vertical line in FIG. 1, located slightly in front of the heel of the foot 3. In a variant, the blade 2 extends under the entire sole, rising at the heel.

The shoe element 5 is made of a flexible material, for example of neoprene or of a plastic having similar mechanical characteristics, which is extensible and highly comfortable, making wearing of the fin pleasant and efficient. The shoe element 5 rises above the ankle 8 of the user to a level 9. In a variant, the shoe element stops below the ankle and is then held to the foot firmly using a band of hooked fabric of the "velcro" type, which passes over the instep and into the sole.

The shoe element 5 is connected to the blade 2 by a covering 10 made of a material which is more rigid than that of the shoe element 5. The material of the covering 10 advantageously consists of thermoplastic rubber whose density is less than 1.

The covering 10 covers at least the front part 11 (see FIG. 2) of the shoe element 5, that is to say the part covering the toes of the foot of the user. The covering 10 is connected to the blade 2. The contour of the front part of the covering 10 descends along lines 12 on either side of the shoe, as shown by FIG. 1, so as not to trap the foot of the user too strongly and to retain the comfort created by the flexible material of the shoe element 5. The covering 10 advantageously extends under the entire sole 4, as shown by FIG. 1, and rises backwards along lines 13 on either side of the shoe element so as to enclose the lower part of the heel of the shoe element 5 in a turn-up 14.

The part 6 of the blade 2 is to some degree embedded in the covering 10 whose thickness, as shown by FIG. 1, is larger behind the boundary 7 in order to compensate for the absence of the part 6 of the blade, or may also be thinner if the part 2 of the blade rises up to the heel.

This blade includes, on these two longitudinal edges, ridges 15, 16 which project essentially upwards, substantially perpendicularly to the main plane of the blade 2. The ridges 15, 16 may extend slightly below the blade 2 by ribs such as **15*a* (FIG. 1) whose height decreases from the front end towards the rear part of the blade, the lower edge of the rib 15*a*** connecting, at the rear, with the lower surface of the assembly.

Advantageously, a longitudinal central rib 17 is provided on the upper face of the blade 2, this rib having a height less than that of the ridges 15, 16. The rear end of the rib 17 is embedded in the covering 10. The ridges 15, 16 and the rib 17 give the fin directional qualities. In particular, a sportsperson who is equipped with such a fin device and who is lying face-down on a board propelled by the crest of a wave can steer by keeping the fins on the surface of the water, the ridges 15, 16 and the rib 17 being immersed in the water. The blade 2 includes, in its part 6 lying below the sole, substantially in the region located under the arch of the foot 3, at least one hole 18 allowing, in particular, injection of the covering 10.

The shoe element 5 is equipped, in a region lying above the ankle 8, with a tightening belt 19, consisting in particular of a band of fabric fitted with conjugate hooks, such as the one known by the brand name "velcro". This belt 19 is engaged in at least two buckles 20, or loops, fixed, in particular by sewing, in the vicinity of the front and rear middle top ends of the shoe element 5. Tightening the belt 19 around the leg of the user makes it possible to close the shoe element 5 in practically leaktight manner around the leg and establishes a mechanical connection between the leg and the shoe element.

With the fin device 1 of the invention, the sportsperson, while benefiting from the comfort of the flexible material of the shoe element 5, can efficiently transmit momentum to the blade 2 by virtue of the covering 10 which connects and covers the toe region which is mainly involved in propulsion. This covering 10 furthermore constitutes a protection.

Figure 3:
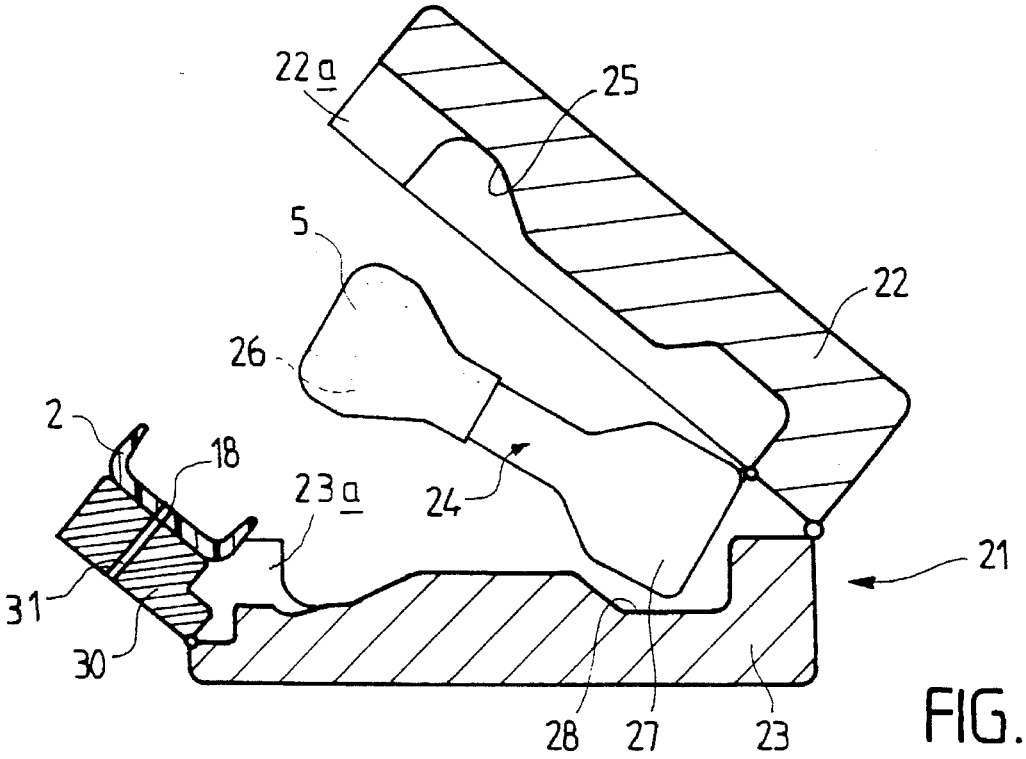
FIG. 3 is a diagrammatic view in vertical section of a mould, in the open position, including an internal former for moulding the fin device according to the invention.

An advantageous method of manufacture of the fin device of the invention will now be described with reference to FIGS. 3 and 4.

After having separately prepared, on the one hand, the blade 2 with its rear part 6 and, on the other hand, the shoe element 5, the procedure is as follows.

Use is made of a mould 21 including two halves 22, 23 which are articulated in order to be openable. A former 24 is connected by an articulation to the upper half of the mould 22 so as to be capable of being released from an impression 25 provided in this half 22 and corresponding to the former 24. The end part 26 of the former 24 which is away from the articulation of the two halves 22, 23 corresponds to the average shape of a foot for a given size. The shoe element 5, generally made of neoprene, is slipped over this part 26. The former 24 has a thinner intermediate region between this part 26 and the other, widened end 27.

The lower half 23 of the mould includes an impression 28 corresponding substantially to the impression 25 of the upper half. The whole is such that, when the half 22 is folded down onto the half 23, and the mould is closed, the former 24 is housed in the volume defined by the impressions 25, 28. The wall of these impressions defines, around the sole of the shoe element 5, a free space 29 intended to receive the covering 10 which will be injected.

The space 29 is closed, on the side opposite the articulation, by the part 6 (see FIG. 4) of the blade 2 which is applied against the openings 22*a*, 23*a* of the front ends of the halves 22, 23, by an articulated block 30 forming a part of the mould. The block 30 includes a channel 31 arranged so as to be located in line with the hole 18 in the part 6 of the blade.

Figure 4:
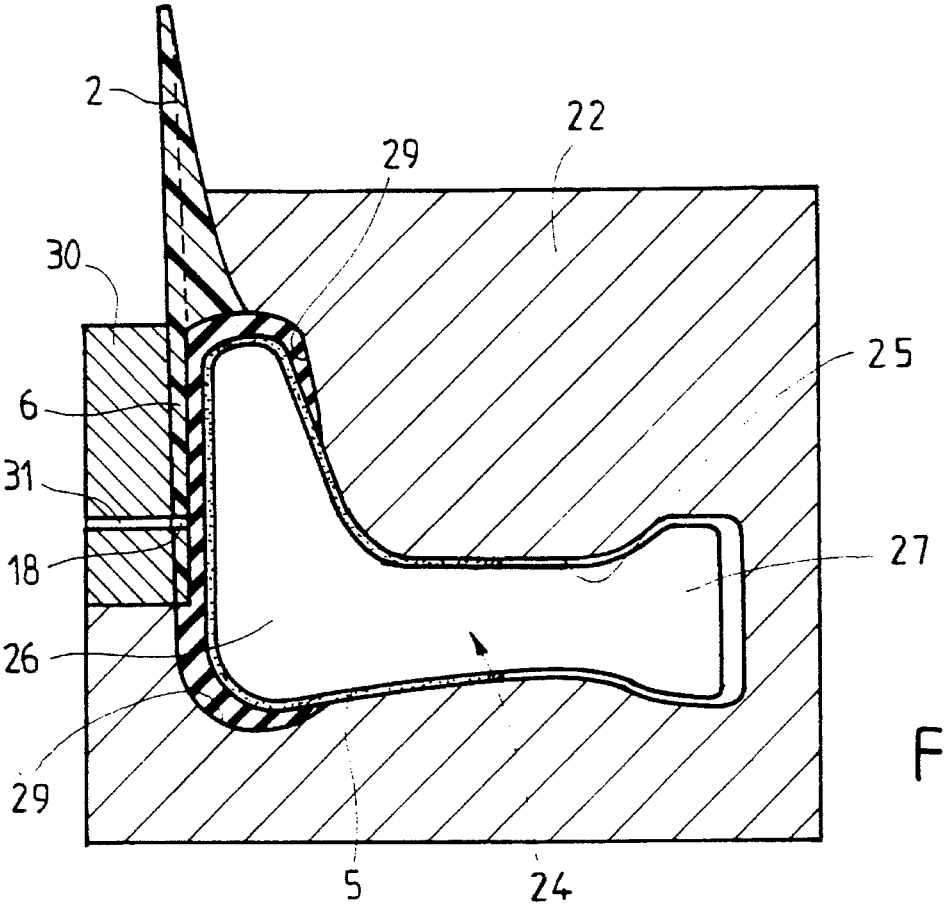
FIG. 4 is a horizontal section of the closed mould, after injection of the covering.

When the mould is closed, the various pieces occupy the positions illustrated in FIG. 4.

The mould is then heated to the moulding temperature, for example of the order of 200°, and the material of the covering 10, in particular thermoplastic rubber, is injected through the channel 31 so as to pass through the orifice 18 and fill the space 29, thus establishing particularly effective connection between the part 6 of the blade 2 and the relevant regions of the shoe element 5. For demoulding, the mould is opened and the shoe element 5 is removed from the former 26.

It should be noted that thermoplastic rubber adheres particularly well to neoprene. A covering 10 made of polyurethane would also give good results with a shoe element 5 made of neoprene.

In the case in which the ridges of the blade have sufficiently low height to allow normal demoulding, the injection can be carried out in a single step; the covering 10 is then made of the same material as the blade 2 and forms a single piece with it. The shoe 5 is fitted on a former similar to the former 24 in FIGS. 3 and 4. When closing the mould, a space is defined which corresponds to the entire blade and covering. Injecting plastic into the mould makes it possible to produce the blade and the covering for connection to the shoe 5 in a single operation.

I claim:

1. Fin device comprising a frontal part forming a blade, made of a relatively rigid material, and means for fastening the blade to a foot of a user, said blade being fixed in its rear region under a sole of a shoe element made of a material more flexible than that of the blade, said shoe element having a heel region and a front part provided with a covering made of a material which is more rigid than that of the shoe element, said covering being solidly attached to the blade and being capable of correctly transmitting momentum from the foot to the blade, and said covering extending under the entire sole of the shoe element and rising, towards a rear part to surround the heel region.

2. Device according to claim 1, wherein the blade extends under at least part of the sole.

3. Device according to claim 2, wherein the blade includes at least one hole in a part intended to be located under the sole, said hole allowing injection of one of said covering and an adhesive.

4. Device according to claim 1, wherein the shoe element includes an upright part which surrounds the ankle of the foot of the user, said upright part including a tightening belt connected to the shoe element by at least two loops, said belt allowing the entire periphery of the upright part of the shoe element to be tightened around the leg of the user.

5. Device according to claim 4, wherein the shoe element is made of neoprene, while the covering which joins the shoe element to the blade is made of a thermoplastic material whose density is less than one, in order to make the fin unsinkable.

6. Device according to claim 5, wherein the tightening belt is made of a band of fabric fitted with complementary hooks.

7. Device according to claim 1, wherein the blade includes two sides, each side having a lateral ridge whose mid-plane is substantially orthogonal to the plane of the blade, said blade further including a longitudinal central rib of lesser height than the lateral ridges.

8. Device according to claim 1, wherein the covering which joins the shoe element to the fin has a hardness less than or equal to that of the blade.

9. Method of manufacture of a fin device comprising a front part forming a blade, made of a relatively rigid material, and means for fastening the blade to a foot of a user, said blade being fixed in its rear region under a sole of a shoe element made of a material more flexible than that of the blade, said shoe element having a front part provided with a covering made of a material which is more rigid than that of the shoe element, said covering being solidly attached to the blade and being capable of correctly transmitting momentum from the foot to the blade, said method comprising:

manufacturing in a first step, from a relatively rigid material, the blade by injection, while making at least one hole in a part of the said blade intended to be located under the sole of the shoe element;

placing in a second step, the shoe element on a former arranged in mold halves which form a cavity, whereby a free space is left between the internal surface of the cavity of the mold halves and the shoe element engaged on the former, in a region intended to receive the covering, and each half of the mold has an opening, under the sole of the shoe element, which is intended to be closed by a block facing a rear region of the blade;

fitting the blade on the block via its rear region, said block including a duct aligned with a hole in the blade for injecting the covering material, then, after having closed the mold, injecting said covering into the free space aligned between the former, the halves of the mold and a region of the blade, whereby the covering spreads and establishes connection between the blade and the shoe element.

10. Method according to claim 9, wherein the covering extends under the entire sole of the shoe element and rises at the heel, said covering joining the rear part of the blade continuously.

* * * * *